US009303336B2

(12) United States Patent
Tharpe, Jr. et al.

(10) Patent No.: US 9,303,336 B2
(45) **Date of Patent: *Apr. 5, 2016**

(54) METHODS FOR MAKING ELASTIC COMPOSITE YARNS

(75) Inventors: Ralph B. Tharpe, Jr., Greensboro, NC (US); John L. Allen, Jr., Greensboro, NC (US); Fulton A. Little, Wadesboro, NC (US); Reuben E. Hart, Greensboro, NC (US)

(73) Assignee: CONE DENIM LLC, Greensboro, NC (US)

( * ) Notice: Subject to any disclaimer, the term of this patent is extended or adjusted under 35 U.S.C. 154(b) by 558 days.

This patent is subject to a terminal disclaimer.

(21) Appl. No.: 13/490,384

(22) Filed: Jun. 6, 2012

(65) Prior Publication Data

US 2012/0244771 A1 Sep. 27, 2012

Related U.S. Application Data

(60) Continuation of application No. 12/841,920, filed on Jul. 22, 2010, now Pat. No. 8,215,092, which is a division of application No. 12/104,316, filed on Apr. 16, 2008, now Pat. No. 8,093,160.

(60) Provisional application No. 60/907,774, filed on Apr. 17, 2007.

(51) Int. Cl.

| | |
|---|---|
| ***D02G 3/32*** | (2006.01) |
| ***D01H 1/00*** | (2006.01) |
| ***D03D 15/12*** | (2006.01) |

(52) U.S. Cl.

CPC .. *D02G 3/32* (2013.01); *D01H 1/00* (2013.01); *D02G 3/328* (2013.01); *D03D 15/12* (2013.01);

(Continued)

(58) Field of Classification Search

CPC ..... D01H 1/00; D02G 3/32; D02G 3/328; D03D 15/12

See application file for complete search history.

(56) References Cited

U.S. PATENT DOCUMENTS

| | | | |
|---|---|---|---|
| 3,127,731 | A | 4/1964 | McKinnon |
| 3,596,458 | A | 8/1971 | Nakano et al. |

(Continued)

FOREIGN PATENT DOCUMENTS

| | | |
|---|---|---|
| CN | 1632204 | 6/2005 |
| EP | 1350872 | 10/2003 |

(Continued)

OTHER PUBLICATIONS

International Search Report dated Aug. 8, 2008 (3 pages).

(Continued)

*Primary Examiner* — Shaun R Hurley

(74) *Attorney, Agent, or Firm* — Nixon & Vanderhye P.C.

(57) ABSTRACT

Methods are provided to make composite yarns having a filamentary core with at least one elastic performance filament and at least one inelastic control filament. A fibrous sheath, preferably formed from spun staple fibers, surrounds the filamentary core, preferably substantially along the entire length thereof. The at least one elastic performance filament most preferably includes a spandex and/or a lastol filament. The at least one inelastic control filament is most preferably formed of a textured polymer or copolymer of a polyamide, a polyester, a polyolefin and mixtures thereof. Preferably, the fibrous sheath is formed of synthetic and/or natural staple fibers, most preferably staple cotton fibers. The elastic composite fibers find particular utility as a component part of a woven textile fabric, especially as a stretch denim fabric, which exhibits advantageous elastic recovery of at least about 95.0% (ASTM D3107).

5 Claims, 2 Drawing Sheets

(52) U.S. Cl.
CPC ..... *Y10T 428/2913* (2015.01); *Y10T 428/2929* (2015.01); *Y10T 442/3024* (2015.04); *Y10T 442/3073* (2015.04); *Y10T 442/3081* (2015.04); *Y10T 442/3179* (2015.04); *Y10T 442/3293* (2015.04)

(56) References Cited

U.S. PATENT DOCUMENTS

| | | | | |
|---|---|---|---|---|
| 3,771,525 | A | 11/1973 | Chapuis | |
| 4,226,076 | A | 10/1980 | Griset, Jr. | |
| 4,283,194 | A | 8/1981 | Teague et al. | |
| 4,342,565 | A | 8/1982 | Teague et al. | |
| 4,450,675 | A * | 5/1984 | Petrov et al. | 57/6 |
| 4,467,595 | A | 8/1984 | Kramers | |
| 4,470,250 | A | 9/1984 | Arenz et al. | |
| 4,509,320 | A | 4/1985 | Maeda | |
| 4,829,757 | A | 5/1989 | Canton | |
| 4,958,485 | A | 9/1990 | Montgomery et al. | |
| 4,961,306 | A | 10/1990 | Sawhney et al. | |
| 4,998,403 | A | 3/1991 | Bailey | |
| H1225 | H * | 9/1993 | Foy et al. | 57/5 |
| 5,303,550 | A | 4/1994 | Setzer | |
| 5,478,514 | A | 12/1995 | Hamilton | |
| 5,531,063 | A | 7/1996 | Sawhney et al. | |
| 5,560,192 | A | 10/1996 | Frith | |
| 5,568,719 | A | 10/1996 | Proctor | |
| 5,701,729 | A | 12/1997 | Rees et al. | |
| 5,735,110 | A | 4/1998 | Kruger et al. | |
| 6,182,434 | B1 * | 2/2001 | Kubovy et al. | 57/354 |
| 6,293,079 | B1 | 9/2001 | Heinzle et al. | |
| 6,370,858 | B1 | 4/2002 | Mori | |
| 6,460,322 | B1 | 10/2002 | Sato et al. | |
| 6,521,000 | B1 | 2/2003 | McFarland et al. | |
| 6,782,685 | B2 | 8/2004 | Bischofberger et al. | |
| 6,782,923 | B2 | 8/2004 | Covelli | |
| 6,815,060 | B2 | 11/2004 | Yuuki | |
| 6,918,413 | B2 | 7/2005 | Ono et al. | |
| 7,036,299 | B2 | 5/2006 | Hietpas et al. | |
| 7,104,483 | B2 * | 9/2006 | D'Agnolo | 242/155 R |
| 7,134,265 | B2 | 11/2006 | Shigemura | |
| 7,143,790 | B2 | 12/2006 | Liao | |
| 7,299,828 | B2 | 11/2007 | Liao | |
| 7,310,932 | B2 | 12/2007 | Liao | |
| 7,413,802 | B2 | 8/2008 | Karayianni et al. | |
| 7,461,499 | B2 | 12/2008 | Liao | |
| 7,637,091 | B2 | 12/2009 | Liao | |
| 7,765,835 | B2 * | 8/2010 | Karayianni et al. | 66/172 E |
| 8,215,092 | B2 * | 7/2012 | Tharpe et al. | 57/224 |
| 2003/0186610 | A1 | 10/2003 | Peters et al. | |
| 2004/0237494 | A1 | 12/2004 | Karayianni et al. | |
| 2006/0040101 | A1 | 2/2006 | Hietpas et al. | |
| 2006/0096073 | A1 † | 5/2006 | Stoppa | |
| 2006/0201129 | A1 | 9/2006 | Bumgardner | |
| 2007/0059524 | A1 † | 3/2007 | Voigt | |
| 2008/0318485 | A1 | 12/2008 | Cheng | |
| 2013/0260129 | A1 | 10/2013 | Agzikara et al. | |

FOREIGN PATENT DOCUMENTS

| | | | |
|---|---|---|---|
| JP | 11-21732 A | † | 1/1999 |
| JP | 4104190 B2 | † | 6/2008 |
| WO | 2006/051380 | | 5/2006 |
| WO | 2006/051384 A1 | † | 5/2006 |

OTHER PUBLICATIONS

Written Opinion dated Aug. 8, 2008 (5 pages).
ASTM D3107, ASTM International (2007).

* cited by examiner
† cited by third party

METHODS FOR MAKING ELASTIC COMPOSITE YARNS

CROSS-REFERENCE TO RELATED APPLICATION

This application is a continuation of commonly owned copending U.S. application Ser. No. 12/841,920 filed Jul. 22, 2010 (now U.S. Pat. No. 8,215,092), which in turn is a divisional of U.S. application Ser. No. 12/104,316 filed on Apr. 16, 2008 (now U.S. Pat. No. 8,093,160), which in turn is based on and claims domestic priority benefits under 35 USC §119(e) from U.S. Provisional Application Ser. No. 60/907,774 filed on Apr. 17, 2007, the entire contents of each of which are expressly incorporated hereinto by reference.

FIELD OF THE INVENTION

The present invention relates generally to elastic composite yarns having an elastic core filament and a fibrous sheath covering the core filament. In especially preferred forms, the present invention is embodied in ring spun yarns having an elastic core which may be woven into fabrics exhibiting excellent recovery characteristics.

BACKGROUND AND SUMMARY OF THE INVENTION

A. Definitions

As used herein and in the accompanying claims, the terms below are intended to have the following definitions:

"Filament" means a fibrous strand of extreme or indefinite length.

"Fiber" means a fibrous strand of definite or short length, such as a staple fiber.

"Yarn" means a collection of numerous filaments or fibers which may or may not be textured, spun, twisted or laid together.

"Sliver" means a continuous fibrous strand of loosely assembled staple fibers without twist.

"Roving" means a strand of staple fibers in an intermediate state between sliver and yarn. According to the present invention, the purpose of a roving is to provide a package from which a continuous stream of staple fibers is fed into the twist zone for each ring spinning spindle.

"Spinning" means the formation of a yarn by a combination of drafting and twisting or prepared strands of staple fibers, such as rovings.

"Core spinning" means introducing a filamentary strand into a stream of staple fibers so that the staple fibers of the resulting core spun yarn more or less cover the filamentary strand.

"Woven fabric" means a fabric composed of two sets of yarns, warp and filling, and formed by interlacing (weaving) two or more warp yarns and filling yarns in a particular weave pattern (e.g., plain weave, twill weave and satin weave). Thus, during weaving the warp and fill yarns will be interlaced so as to cross each other at right angles to produce the woven fabric having the desired weave pattern.

"Draft ratio" is the ratio between the length of a stock filamentary strand from a package thereof which is fed into a spinning machine to the length of the filamentary strand delivered from the spinning machine. A draft ratio of greater than 1.0 is thus a measure of the reduction in bulk and weight of the stock filamentary strand.

"Package length" is the length of a tensioned filament or yarn forming a package of the same.

"Elastic recovery" means that a filament or fabric is capable of recovery to its original length after deformation from elongation or tension stress.

"Percent elastic recovery" is a percentage ratio of the length of a filament or fabric prior to being subjected to elongation or tension stress to the length of the filament or fabric following release of elongation or tension stress. A high percent elastic recovery therefore means that the filament or fabric is capable of returning substantially to its original pre-stressed length. Conversely, a low percent elastic recovery means that the filament or fabric is incapable of returning substantially to its original pre-stressed length. The percent elastic recovery of fabrics is tested according to ASTM D3107 (the entire content of which is expressly incorporated hereinto by reference).

An "elastic filament" means a filament that is capable of stretching at least about 2 times its package length and having at least about 90% elastic recovery up to 100% elastic recovery. Thus, the greater that a yarn of fabric which includes an elastic filament is stretched, the greater the retraction forces of such yarns and fabrics.

An "inelastic filament" means a filament that is not capable of being stretched beyond its maximum tensioned length without some permanent deformation. Inelastic filaments are therefore capable of being stretched only about 1.1 times their tensioned (package) length. However, due to texturing (crimping), an inelastic filament may exhibit substantial retraction force and thereby exhibit substantial percent elastic recovery.

II. BACKGROUND OF THE INVENTION

Composite elastic yarns are in and of themselves well known as evidenced, for example, by U.S. Pat. Nos. 4,470,250; 4,998,403; 5,560,192; 6,460,322 and 7,134,265.[1] In general, conventional composite elastic yarns comprise one or more elastic filaments as a core covered by a relatively inelastic fibrous or filamentary sheath. Such elastic composite yarns find a variety of useful applications, including as component filaments for making stretchable textile fabrics (see, e.g., U.S. Pat. No. 5,478,514). Composite yarns with relatively high strength inelastic filaments as a core surrounded by a sheath of other filamentary material are also known, for example, from U.S. Pat. No. 5,735,110.

[1]The entire contents of each of these cited U.S. patents as well as each U.S. patent cited hereinafter are expressly incorporated into this document by reference as if each one was set forth in its entirety herein.

Woven fabrics made of such yarns, in particular ring spun yarns with an elastic core can be used to make woven stretch fabrics. Typically these fabrics have an elongation of 15 to 40% usually in the weft direction only, but sometimes also in the warp directions. A typical problem with these fabrics is that the recovery characteristics can be poor, usually on the order of as low as 90% (ASTM D3107).

Fabrics made with yarns having "inelastic filaments" with retraction power due to artificial crimp (textured or self textured as in elasterell-p, PTT/PET bi-component fibers) generally have low elongation in the range of 10 to 20%. In general, these fabrics have excellent recovery characteristics when tested using ASTM D3107.

III. SUMMARY OF THE INVENTION

It would therefore be highly desirable if the excellent recovery properties of inelastic filaments could be combined with the excellent elongation or stretch properties of elastic filaments in the same ring spun core yarn. If such a ring spun core yarn were possible, then several problems would be solved. For example, fabrics made from such ring spun core yarns would exhibit both good stretch and excellent recovery according to ASTM D3107, could be heat-set with better control of stretch properties, and could be made into garments and subsequently resin treated with much better recovery remaining after the treatment. It is towards fulfilling such a need that the present invention is directed.

Broadly, the present invention is embodied in ring-spun yarns which satisfy the need in this art noted above. In accordance with one preferred embodiment of the present invention, a composite yarn is provided which includes a filamentary core comprised of an elastic performance filament and an inelastic control filament, and a fibrous sheath surrounding the filamentary core, preferably substantially along the entire length thereof. The fibrous sheath is preferably ring-spun from a roving of staple fibers and thereby forms an incoherent mass of entangled spun staple fibers as a sheath surrounding the elastic and inelastic filaments.

According to some preferred embodiments of the invention, an elastic composite yarn is provided wherein at least one elastic performance filament comprises a spandex and/or a lastol filament, and wherein at least one inelastic control filament comprises a filament formed of a polymer of copolymer of a polyamide, a polyester, a polyolefin and mixtures thereof. Preferably, the fibrous sheath comprises synthetic and/or natural staple fibers. In especially preferred embodiments, the fibrous sheath comprises staple cotton fibers.

The elastic composite fibers of the present invention find particular utility as a component part of a textile fabric. Thus, according to some embodiments of the present invention, the composite elastic filaments will be woven into a textile fabric, preferably a denim fabric.

The composite elastic yarn may be made by providing a filamentary core comprised of at least one elastic performance filament and at least one inelastic control filament, wherein the at least one elastic performance filament has a draft ratio which is at least two times, preferably at least three times, the draft ratio of the at least one inelastic control filament; and thereafter spinning a fibrous sheath around the filamentary core. The filamentary core may be supplied to the spinning section as a preformed unit, for example by joining the elastic and inelastic fibers in advance and providing such a filamentary core stock on a package to be supplied to the spinning section. Alternatively, the filamentary core may be formed immediately in advance of the spinning section by unwinding the elastic performance filament and the inelastic control filament from respective separate supply packages, and bringing filaments together prior to spinning of the fibrous sheath thereabout. The elastic performance filament and the inelastic control filament may thus be acted upon by respective draw ratio controllers so as to achieve the desired draw ratio differential therebetween as briefly noted above.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
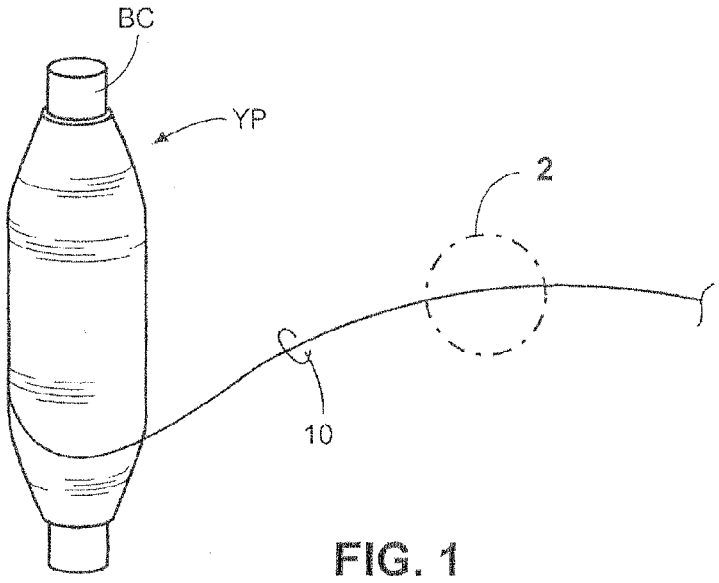
FIG. 1 is a schematic representation of a yarn package of a composite yarn in accordance with the present invention.
Figure 2:
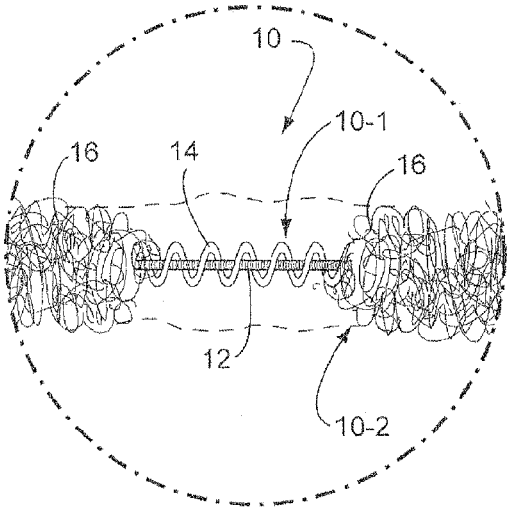
FIG. 2 is a greatly enlarged schematic view of a section of the composite yarn shown in FIG. 1 in a relaxed (non-tensioned) state.
Figure 3:
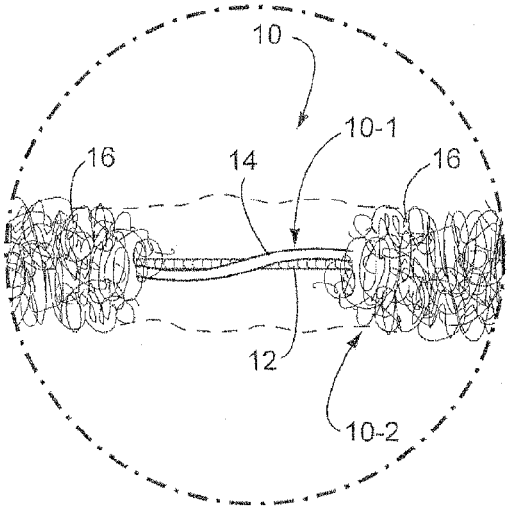
FIG. 3 is a greatly enlarged schematic view of a section of the composite yarn similar to FIG. 2 but shown in a tensioned state.

As depicted in FIGS. 1-3, the present invention is most preferably embodied in a composite yarn 10 which may be wound around a bobbin BC so as to form a yarn package YP thereof. The yarn package YP may therefore be employed in downstream processing to form a textile fabric, preferably a woven fabric, according to techniques well known to those in this art.

The composite yarn 10 according to the present invention will necessarily include a filamentary core 10-1 comprised of at least an elastic performance filament 12 and an inelastic control filament 14. The filamentary core 10-1 is surrounded, preferably along the entirety of its length by a fibrous sheath 10-2 comprised of a mass of spun staple fibers 16.

Although not shown in FIGS. 2-3, the filamentary core 10-1 may comprise additional filaments deemed desirable for the particular end use application contemplated for the composite filament 10. Furthermore, filaments 12 and 14 are depicted in FIGS. 2-3 as monofilaments for ease of illustration only. Thus, the elastic performance filament 12 and/or the inelastic control filament 14 may be comprised of multiple filaments. In one especially preferred embodiment of the present invention, the elastic performance filament is a single filament while the inelastic control filament is a multifilament. More specifically, the preferred elastic performance filament may advantageously be formed of multiple elastic monofilaments which are coalesced with one another so as to in essence form a single filament. On the other hand, the inelastic control filament is formed of multiple monofilaments and/or multiple filaments of spun staple fibers.

As depicted schematically in accompanying FIG. 2, when the composite yarn 10 is in a non-tensioned state, the inelastic control filament 14 is twisted relatively loosely around the elastic performance filament 12. Such relative loose twisting of the inelastic control filament 14 about the elastic performance filament 12 thus allows the elastic filament 12 to be extensible under tension until a point is reached whereby the inelastic control filament 14 reaches its extension limit (i.e., a point whereby the relative looseness of the inelastic filament has been removed along with any extensibility permitted by filament texturing (crimping) that may be present such that any further tensioning would result in permanent deformation or breakage). Such a tensioned state is depicted schematically in accompanying FIG. 3.

It will be understood that, since the fibrous sheath 10-2 is comprised of an incoherent mass of entangled, randomly oriented spun staple fibers, it will permit the extension of the elastic performance filament 12 to occur up to the limit of the inelastic control filament 14 without physical separation. Furthermore, the fibrous sheath itself serves to limit the extensibility of the elastic performance filament 12, albeit to a much lesser extent as compared to the inelastic control filament 14.

Thus, throughout repeated tensioning and relaxation cycles, the fibrous sheath 10-2 will continue to visibly hide the filamentary core 10-1.

Virtually any commercially available elastomeric filament may be employed satisfactorily as the elastic performance filament 12 in accordance with the present invention. Preferred are elastic filaments made from spandex or lastol polymers. As is well known, spandex is a synthetic filament formed of a long chain synthetic elastomer comprised of at least 85% by weight of a segmented polyurethane. The polyurethane segments of spandex are typically interspersed with relatively soft segments of polyethers, polyesters, polycarbonates or the like. Lastol is an elastic polyolefin having a cross-linked polymer network structure, as disclosed more fully in U.S. Pat. Nos. 6,500,540 and 6,709,742. Other suitable elastomeric polyolefins may also be employed in the practice of the present invention, including homogeneously branched linear or substantially linear ethylene/α-olefin interpolymers, e.g. as disclosed in U.S. Pat. Nos. 5,272,236, 5,278,272, 5,322,728, 5,380,810, 5,472,775, 5,645,542, 6,140,442, and 6,225,243.

A particularly preferred spandex filament is commercially available from Invista (formerly DuPont Textiles & Interiors) under the trade name LYCRA® having deniers of about 40 or about 70. A preferred lastol filament is commercially available from Dow Fiber Solutions under the tradename XLA™ having deniers of about 70, 105, or 140.

The inelastic control filament may be virtually any inelastic filament known to those in the art. Suitable inelastic control filaments include filaments formed of virtually any fiber-forming polymers such as polyamides (e.g., nylon 6, nylon 6,6, nylon 6,12 and the like), polyesters, polyolefins (e.g., polypropylene, polyethylene) and the like, as well as mixtures and copolymers of the same. Presently preferred for use as the inelastic control filament are polyester filaments, such as those commercially available from Unifi, Inc. in 1/70/34 stretch textured polyester or 1/70/34 in set textured polyester.

The relative denier of the elastic performance filament 12 and the inelastic control filament 14 may be substantially the same or substantially different. In this regard, the denier of the elastic performance filament 12 may vary widely from about 10 to about 140, preferably between about 40 to about 70. After the proper draft ratio is applied the denier of the elastic filament inside a tensioned yarn would be about 5 to 70, preferably between 10 and 25. The denier of the inelastic control filament 14 may vary widely from about 40 to about 150, preferably between about 70 to about 140. In one particularly preferred embodiment of the invention, the denier of the elastic performance filament 12 and the inelastic control filament 14 is each about 70.

As noted briefly above, the fibrous sheath 10-2 is formed from a relatively dense mass of randomly oriented entangled spun synthetic staple fibers (e.g., polyamides, polyesters and the like) or spun natural staple fibers (e.g., cotton). In especially preferred embodiments, the fibrous sheath 10-2 is formed of spun cotton fibers. The staple fiber length is not critical. Typical staple fiber lengths of substantially less than one inch to several inches may thus be used.

Figure 4:
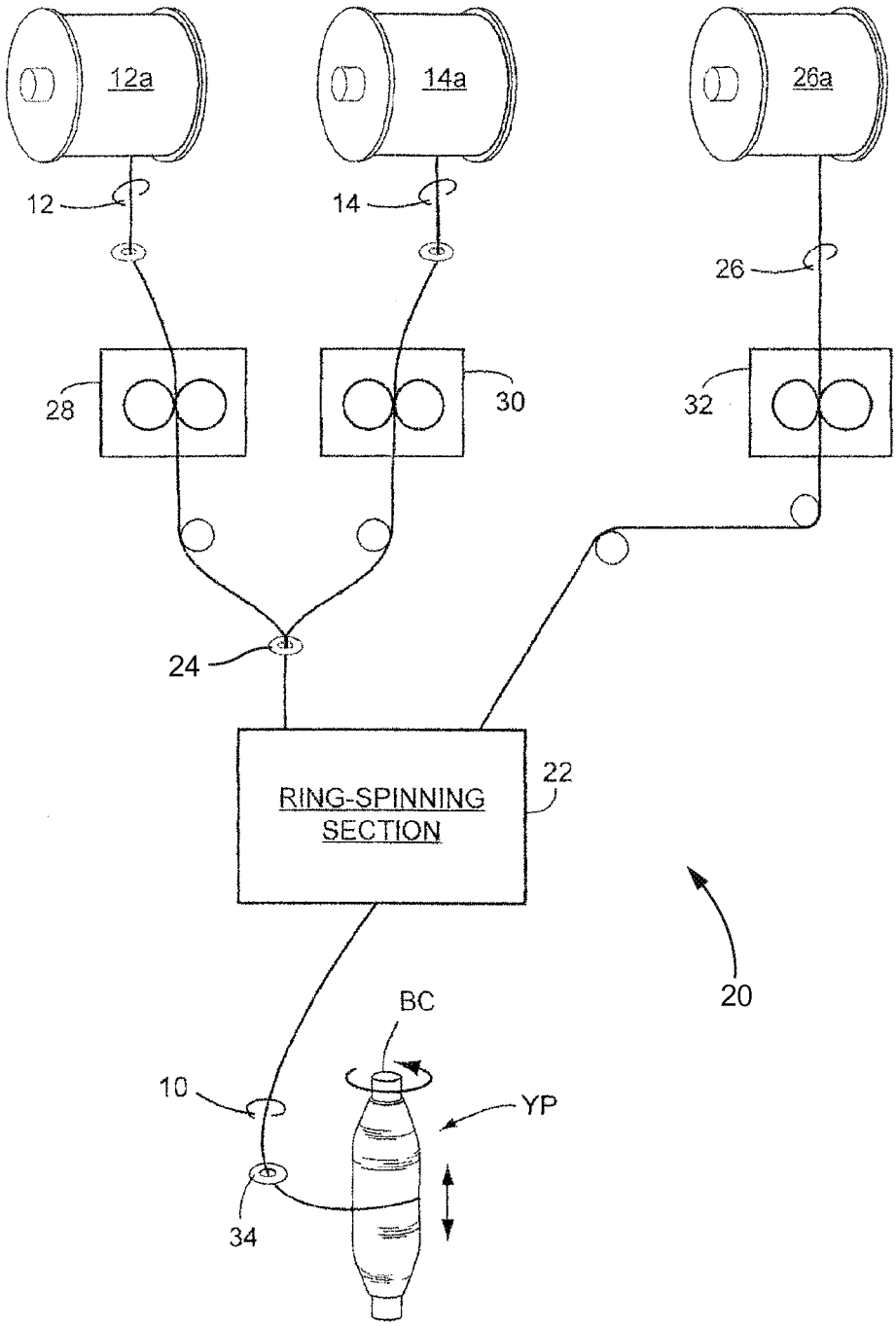
FIG. 4 is a schematic representation of a process and apparatus for making the composite yarn in accordance with the present invention.

The composite yarn 10 may be made by virtually any staple fiber spinning process known to those in this art, including core spinning, ring spinning and the like. Most preferably, however, the composite yarn 10 is made by a ring spinning system 20 depicted schematically in accompanying FIG. 4. As shown, the preferred ring spinning system 20 includes a ring-spinning section 22. The elastic performance filament 12 and the inelastic control filament 14 forming the filamentary core 10-1 are removed from a creel-mounted supply package 12*a*, 14*a*, respectively, and brought together at a merger ring 24 prior to being fed to the ring-spinning section 22. A roving 26 of the staple fibers to be spun into the fibrous sheath 10-2 is similarly removed from a creel mounted supply package 26*a* and directed to the ring-spinning section 22.

The size of the roving is not critical to the successful practice of the present invention. Thus, rovings having an equivalent cotton hank yarn count of between about 0.35 to about 1.00, preferably between about 0.50 to about 0.60 may be satisfactorily utilized. In one preferred embodiment of the invention, a roving of cotton staple fibers is employed having a cotton hank yarn count of 0.50 and is suitably spun with the elastic and inelastic core filaments to achieve a resulting equivalent cotton yarn count of 14/1. Filamentary cores totaling about 90 denier can be suitably spun with a fibrous sheath to equivalent cotton yarn counts ranging from 20/1 to 8/1, while filamentary cores totally 170 denier can be suitably spun with a fibrous sheath to yarn counts ranging from 12/1 to 6/1.

Individual independently controllable draft ratio controllers 28, 30 and 32 are provided for each of the filaments 12 and 14, and the roving 26. According to the present invention, the draft ratio controllers 30 and 32 are set so as to feed the inelastic control filament 14 and the roving 26 of staple fibers to the ring-spinning section 22 at a draft ratio of about 1.0 (+/− about 0.10, and usually +/− about 0.05). The draft ratio controller 28 on the other hand is set so as to supply the elastic performance filament 12 to the ring-spinning section 22 at a draft ratio of at least about 2.0, and preferably at least about 3.0. Thus, when joined with the inelastic control filament 14, the elastic performance filament 12 will be at a draft ratio which is at least two times, preferably at least three times, the draft ratio of the inelastic control filament 14. The elastic performance filament 12 will thereby be under tension to an extent that it is extended (stretched) about 200%, and preferably about 300% as compared to its state on the package 12*a*. On the other hand, as compared to its state on the package 14*a*, the inelastic control filament 14 will be essentially unextended (unstretched).

The ring-spinning section 22 thus forms the fibrous sheath 10-2 around the filamentary core 10-1 using ring-spinning techniques which are per se known in the art. Such ring-spinning techniques also serve to relatively twist the inelastic control filament 14 about the elastic performance filament. Thus, the ring-spinning of the fibrous sheath 10-2 from the roving 26 of staple fibers and the draft ratio differential as between the elastic performance filament 12 on the one hand and the inelastic control filament on the other hand serve to achieve an elastic composite yarn 10 as has been described previously. The composite yarn may thus be directed to a traveler ring 34 and wound about the bobbin BC to form the yarn package YP.

The composite yarn 10 according to the present invention may be used as a warp and/or filling yarn to form woven fabrics having excellent elastic recovery characteristics. Specifically, according to the present invention, woven fabrics in which the composite yarn 10 is woven as a warp and/or filling yarn in a plain weave, twill weave and/or satin weave pattern, will exhibit a stretch of at least about 15% or greater, more at least about 18% or greater, most preferably at least about 20% or greater. Such fabrics in accordance with the present invention will also preferably exhibit a percent elastic recovery according to ASTM D3107 of at least about 95.0%, more preferably at least about 96.0% up to and including 100%.

The present invention will be further understood as careful consideration is given to the following non-limiting Examples thereof.

EXAMPLES

Example 1

A composite core yarn was made of 70 denier spandex filament commercially obtained from RadicciSpandex Corporation drafted at 3.1 and a 70 denier stretch textured polyester filament (1/70/68) commercially obtained from Unifi, Inc. drafted at 1.0. The composite yarn was spun on a Marzoli ring spinning machine equipped with an extra hanger and tension controllers for the composite core yarn. A hank roving size of 0.50 was used and drafted sufficiently to yield a total yarn count of 14/1. The resulting composite yarn was woven on an X-3 weaving machine to create a vintage selvage denim with stretch. The reed density of 14.25 (57 ends in reed) was used instead of the normal 16.5. The resulting fabric was desized, mercerized, and heat set to a width of 30 inches on a Monforts tenter range. The resulting denim fabric stretch was 18% and the elastic recovery was 96.9% according to ASTM D3107.

A comparison fabric was made using a 14/1 regular core spun yarn containing only 40 denier spandex. The elastic recovery was only 95.5% when tested according to ASTM D3107.

Example 2

A denim fabric was woven using yarns of Example 1 as weft on a Sulzer rapier wide loom. This denim was made with one pick of the 14/1 multi-core yarn followed by one pick of 14/1 normal core spun with 40 denier spandex. This denim was made with 16.0 reed density (64 ends in reed). The fabric was desized and mercerized but not heat set. The resulting fabric had 29% stretch and a recovery of 96.0% based on ASTM D3107.

A comparison fabric was made using all picks of 14/1 normal core spun with 40 denier spandex. The comparison fabric had 25% stretch but only 95.3% recovery when tested according to ASTM 3107.

Example 3

A 3/1 twill bi-directional stretch denim made with warp and weft comprised of multi-core yarns made with the apparatus described in Example 1. The core consisted of a 1/70/34 textured polyester continuous filament strand drafted at 1.00 to 1.02, and a 40 denier spandex elastomeric (RadicciSpandex Corporation) drafted at 3.1. The wrapping or sheath of the core spun yarn consisted of cotton fibers sufficient to provide a total weight of 7.5/1 Ne in warp and 14/1 Ne in weft. The warp yarn was woven at low density and the fill yarn was woven at 48 weft yarns per inch. After mercerization, heat setting, and finishing the final yarn density was 64×52 giving a fabric weight of 11.25 oz. per square yard. The stretch after heat setting was 11% in warp direction with 97% average recovery. The stretch in the weft direction was 22% with a recovery of 96%.

Example 4

A 3/1 twill bi-directional stretch denim was made with warp and weft comprised of multi-core yarns made with the apparatus described in Example 1. The core consisted of a 1/70/34 textured polyester continuous filament strand drafted at 1.00 to 1.02, a 75 denier lastol elastomeric (Dow Chemical, XLA™) drafted at 3.8. The wrapping or sheath of the core spun yarn consisted of cotton fibers sufficient to provide a total weight of 7.5/1 Ne in warp and 11.25/1 Ne in weft. The warp yarn was woven at low density and the fill yarn was woven at 42 weft yarns per inch. After mercerization, heat setting, and finishing the final yarn density was 68×47 giving a fabric weight of 11.50 oz. per square yard. The stretch after finishing was 12.5% in warp direction with 97% average recovery. The stretch in the weft direction was 19% with a recovery of 96%.

Example 5

A 3/1 twill weft stretch denim was made with an all cotton warp having an average yarn number of 9.13 Ne at a density of 57 ends per inch in the loom reed. The weft was comprised of a multi-core yarn made with the apparatus described in Example 1. The core consisted of a 1/70/34 textured polyester continuous filament strand drafted at 1.00 to 1.02, and a 40 denier spandex elastomeric (RadicciSpandex Corporation) drafted at 3.1. The wrapping or sheath of the core spun yarn consisted of cotton fibers sufficient to make a total weight of 14/1 Ne. This yarn was woven at the rate of 45 weft yarns per inch. After mercerization, heat setting, and finishing the final yarn density was 75×48.5 giving a fabric weight of 9.75 oz. per square yard. The stretch after heat setting was 17% with 96.8 average recovery. The overall blend level for the fabric is 93% cotton/6% polyester/1% spandex.

Example 6

A 3/1 twill weft stretch denim was made with an all cotton warp having an average yarn number of 9.13 Ne at a density of 57 ends per inch in the loom reed. The weft was comprised of a multi-core yarn made with the apparatus described in Example 1. The core consisted of a 1/70/34 textured polyester continuous filament strand drafted at 1.00 to 1.02, and a 40 denier spandex elastomeric (RadicciSpandex Corporation) drafted at 3.1. The wrapping or sheath of the core spun yarn consisted of cotton fibers sufficient to make a total weight of 14/1 Ne. This yarn was woven at the rate of 50 weft yarns per inch. After mercerization and finishing the final yarn density was 77×55.5 giving a fabric weight of 10.5 oz. per square yard. The stretch was 26% with 96% average recovery. The overall blend level for the fabric was 92% cotton/7% polyester/1% spandex.

Example 7

A 3/1 twill weft stretch denim was made with an all cotton warp having an average yarn number of 9.13 Ne at a density of 57 ends per inch in the loom reed. The weft was comprised of a multi-core yarn made with the apparatus described in Example 1. The core consisted of a 1/70/34 textured polyester continuous filament strand drafted at 1.00 to 1.02, and a 75 denier lastol elastomeric (Dow Chemical, XLA™) drafted at 4.0. The wrapping or sheath of the core spun yarn consisted of cotton fibers sufficient to make a total weight of 11.25/1 Ne. This yarn was woven at the rate of 46 weft yarns per inch. After mercerization and finishing the final yarn density was approximately 75×51 giving a fabric weight of 11.5 oz. per square yard. The stretch was 17% with 96% average recovery. The overall blend level for the fabric is 93% cotton/6% polyester/1% lastol.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a ring-spun composite elastic yarn, the method comprising:

(a) forming a multi-filamentary core by removing at least one elastic performance filament comprising a spandex and/or a lastol filament and at least one inelastic control filament comprising a filament formed of a polymer or copolymer of a polyamide, a polyester, a polyolefin and mixtures thereof from respective supply packages, and bringing the at least one elastic performance filament and the at least one inelastic control filament in advance of a spinning section of a ring-spinning zone at respective draft ratios such that a draft ratio of the at least one elastic performance filament is at least two times a draft ratio of the at least one inelastic control filament; and (b) directing the multi-filamentary core formed by step (a) to the ring-spinning zone; and (c) joining a roving of staple fibers with the multi-filamentary core at the ring spinning zone and ring-spinning a fibrous sheath of the staple fibers around the multi-filamentary core in the ring-spinning zone to twist the at least one inelastic control filament about the at least one elastic performance filament and thereby form a ring-spun composite elastic yarn capable of being repeatedly cycled between tensioned and relaxed states whereby the at least one inelastic control filament limits extensibility of the at least one elastic performance filament when the composite yarn is in the tensioned state thereof.

2. A method as in claim 1, wherein the at least one elastic performance filament has a draft ratio which is at least three times the draft ratio of the at least one inelastic control filament.

3. A method as in claim 1, wherein the fibrous sheath comprises synthetic and/or natural staple fibers.

4. A method as in claim 1, wherein the fibrous sheath comprises cotton fibers.

5. A method as in claim 1, wherein the at least one elastic performance filament and the at least one inelastic control filament are directed to a merge ring in advance of the spinning section of the ring-spinning zone.

* * * * *